US011566514B2

(12) United States Patent
Luo et al.

(10) Patent No.: US 11,566,514 B2
(45) Date of Patent: Jan. 31, 2023

(54) BOTTOMHOLE CHOKE FOR MANAGED PRESSURE CEMENTING

(71) Applicant: Halliburton Energy Services, Inc., Houston, TX (US)

(72) Inventors: Yan Luo, Frisco, TX (US); Javier Enrique Pozzo Huerta, Santa Cruz de la Sierra (BO); Adan Hernandez Herrera, Baytown, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 38 days.

(21) Appl. No.: 17/073,746

(22) Filed: Oct. 19, 2020

(65) Prior Publication Data

US 2022/0120172 A1 Apr. 21, 2022

(51) Int. Cl.

| | |
|---|---|
| ***E21B 47/06*** | (2012.01) |
| ***E21B 33/13*** | (2006.01) |
| ***E21B 34/06*** | (2006.01) |

(52) U.S. Cl.

CPC ..... *E21B 47/06* (2013.01); *E21B 33/13* (2013.01); *E21B 34/066* (2013.01)

(58) Field of Classification Search

CPC ..... E21B 47/06; E21B 47/005; E21B 33/13; E21B 34/06; E21B 34/08

See application file for complete search history.

(56) References Cited

U.S. PATENT DOCUMENTS

| | | | | |
|---|---|---|---|---|
| 6,244,342 | B1 | 6/2001 | Sullaway et al. | |
| 7,908,034 | B2 | 3/2011 | Gray | |
| 7,997,340 | B2 | 8/2011 | Bostick, III et al. | |
| 8,490,719 | B2 | 7/2013 | Duhe et al. | |
| 9,249,646 | B2 | 2/2016 | Hannegan et al. | |
| 10,077,647 | B2 | 9/2018 | Johnson et al. | |
| 10,087,725 | B2 | 10/2018 | Giroux et al. | |
| 10,174,586 | B2 | 1/2019 | Symms | |
| 10,519,743 | B2 | 12/2019 | Perschke et al. | |
| 2007/0095533 | A1* | 5/2007 | Rogers | E21B 34/102 166/285 |

(Continued)

FOREIGN PATENT DOCUMENTS

| | | | |
|---|---|---|---|
| CA | 2651966 | 8/2011 | |
| EP | 1375817 B1 * | 3/2006 | E21B 21/085 |

(Continued)

OTHER PUBLICATIONS

Christensen et al., "Development and Implementation of the Control System for an Autonomous Choke Valve for Downhole Flow and Pressure Control", Jun. 2016, 138 pages.

(Continued)

*Primary Examiner* — Caroline N Butcher

(74) *Attorney, Agent, or Firm* — Kilpatrick Townsend & Stockton LLP

(57) ABSTRACT

An apparatus for controlling bottomhole pressure in a wellbore during cementing includes a sensor positionable to measure pressure in the bottomhole of the wellbore, a controllable valve, and a controller. The controller may be positionable to receive pressure measurements from the sensor and control the controllable valve to maintain a specified pressure in the wellbore based on the pressure measurements. The apparatus may be positionable in a bottomhole portion of the wellbore.

20 Claims, 8 Drawing Sheets

(56) References Cited

U.S. PATENT DOCUMENTS

| | | | | |
|---|---|---|---|---|
| 2010/0288507 | A1* | 11/2010 | Duhe | E21B 21/08 166/370 |
| 2011/0290485 | A1* | 12/2011 | Cooke, Jr. | E21B 33/14 166/286 |
| 2013/0118752 | A1* | 5/2013 | Hannegan | E21B 33/143 166/336 |
| 2017/0002622 | A1 | 1/2017 | De Bruijn et al. | |
| 2018/0179857 | A1 | 6/2018 | Themig | |
| 2018/0363414 | A1 | 12/2018 | Bogaerts et al. | |
| 2019/0024485 | A1* | 1/2019 | Stromme | E21B 41/0092 |

FOREIGN PATENT DOCUMENTS

| | | | | |
|---|---|---|---|---|
| EP | 2985408 | | 2/2016 | |
| WO | WO-0206634 | A1 * | 1/2002 | E21B 49/003 |

OTHER PUBLICATIONS

Francisco, "Managed Pressure Cementing: Control System Design & Simulation", May 2016, 9 pages.
Watters, "Deepwater Reverse-Circulation Primary Cementing", Sep. 21, 2014, 52 pages.

* cited by examiner

BOTTOMHOLE CHOKE FOR MANAGED PRESSURE CEMENTING

TECHNICAL FIELD

The present disclosure relates generally to wellbore operations. More specifically, but not by way of limitation, this disclosure relates to a bottomhole choke to control bottomhole pressure in a wellbore during managed pressure cementing.

BACKGROUND

At various points in the well drilling and completion processes, casings, or large diameter pipes, are lowered into the open hole, referred to as running casing, and cemented in place. These casings form a structural component of the wellbore and can prevent the formation wall from caving into the wellbore, isolate the different formations to prevent the flow or crossflow of formation fluid, and provide a means of maintaining control of formation fluids and pressure as the well is drilled. For example, casing may be run to protect fresh water formations or isolate formations with significantly different pressure gradients, as well as for other reasons related to well control.

To control pressure during well drilling operations, Managed Pressure Drilling (MPD) provides for real time adjustments of the bottomhole pressure and maintaining the drilling mud equivalent circulating density within the operational pressure window. MPD uses bottomhole pressure measurements obtained via Pressure While Drilling (PWD) techniques to control the pressure of the drilling fluid by controlling a choke valve at the surface of the wellbore. Similarly, Managed Pressure Cementing (MPC) has been used to maintain the pressure of cement within operational pressure windows during cementing operations. MPC operations may be controlled based only on a hydraulic model of the wellbore when bottomhole pressure measurements are unavailable. Even with bottomhole pressure measurements available, data transmission delay can result in delayed response to BHP variations.

DETAILED DESCRIPTION

Certain aspects and examples of the present disclosure relate to sensing and controlling bottomhole pressure (BHP) in a wellbore using an autonomous bottomhole choke during a reverse-circulation primary cementing process. In a reverse-circulation primary cementing process, cement may be pumped downhole in an annulus between the casing and a wall of the wellbore or between two sections of tubing where the cement can flow. Any fluids displaced by the cement in the annulus, such as drilling mud or other well fluids, may be returned through the center of the casing. The bottomhole choke may be an actuator-driven, autonomous choke positionable at a bottom of a casing string to sense and control the BHP during the cementing process.

During drilling and cementing operations, a pressure profile within the well may be maintained between the drilling fluids or cement and the formation through which the well is being drilled. An operational pressure window, such as upper and lower pressure limits, between the pressure of fluids within the pores of a reservoir (pore pressure) and the pressure required to induce fractures in rock at a given depth (facture gradient) may be determined. Failure to maintain the pressure profile in the well within the upper and lower pressure limits of the pressure window can result in lost circulation of wellbore fluid during drilling, while running casing, and during cementing operations.

With the autonomous operation of the bottomhole choke used for MPC, surface equipment and telemetry systems for BHP measurement and control may be minimized. The bottomhole choke can provide real-time pressure sensing and pressure control by controlling the choke valve actuator at the downhole end of the wellbore. Reliance on a hydraulic model to predict and control BHP may be eliminated since the bottomhole choke can sense and control the BHP in real-time. For example, the bottomhole choke may be used to sense and control the BHP during a reverse-circulation primary cementing operation.

Figure 1:
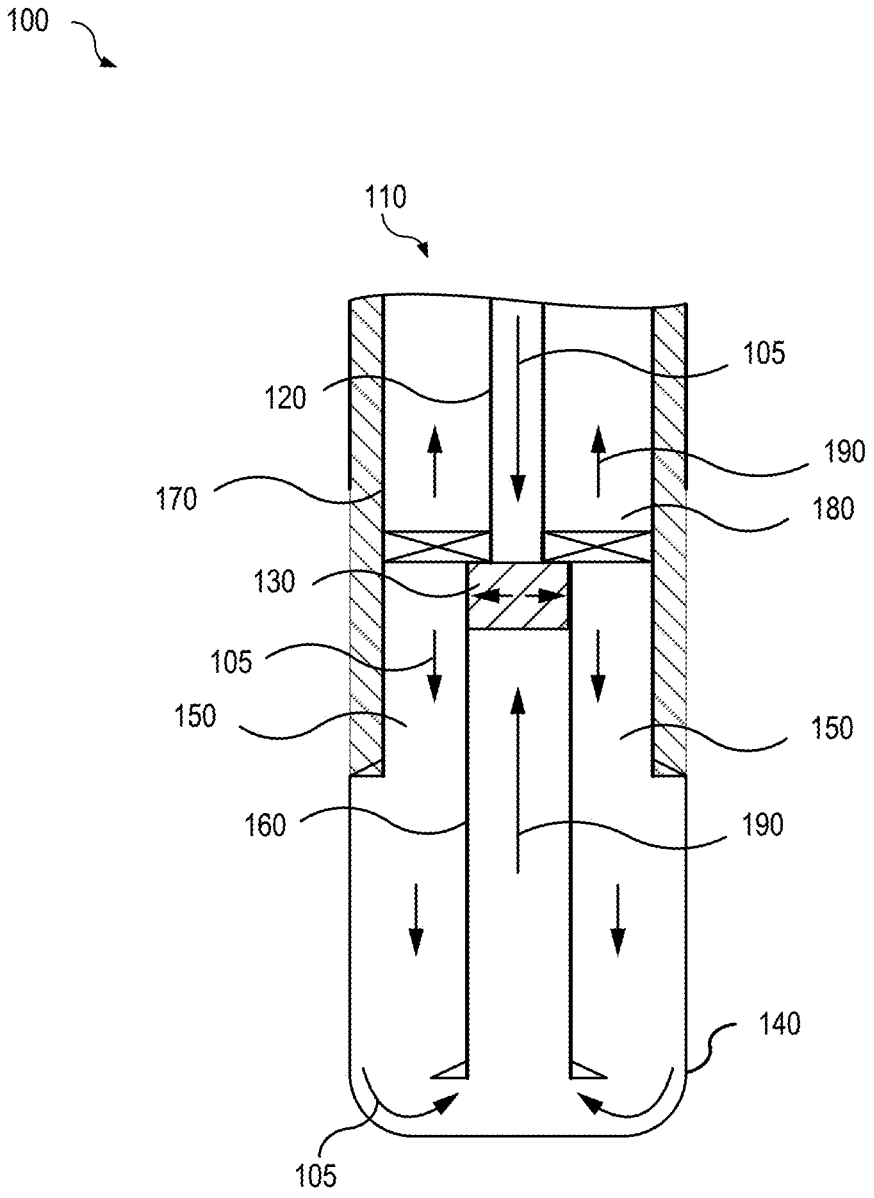
FIG. 1 is a diagram illustrating a reverse-circulation primary cementing operation.

FIG. 1 is a diagram illustrating a reverse-circulation primary cementing operation 100. Reverse-circulation primary cementing is a technique of pumping down cement into an annulus of a wellbore. Referring to FIG. 1, cement 105 may be pumped downhole in a wellbore 110 through a workstring 120 or casing to a crossover tool 130 positioned at a distance above the bottom hole 140. The crossover tool 130 may divert the cement 105 from the workstring 120 into the annulus 150. The cement 105 may then be pumped to the bottomhole 140 in the annulus 150 and return up a liner string 160. The crossover tool 130 may divert any return fluids 190 back into the previous casing 170 and riser annulus 180.

During a cementing operation, for example, a reverse-circulation primary cementing operation, a target pressure value $P_T$ for the BHP can be pre-determined and programmed in a memory of the autonomous bottomhole choke. The target pressure value $P_T$ may be determined based on the characteristics of the wellbore, for example, depth of the wellbore, composition of the formation, etc. The bottomhole choke may be installed at the end of a casing before conveying the casing downhole during the cementing operation. In some implementations, the bottomhole choke may be installed at the end of an inner tubing string. The inner tubing string may be sealed against an outer casing.

Pressure sensors disposed on the bottomhole choke may provide real-time measurements of the BHP. Based on the real-time measurements of the BHP and the target pressure value $P_T$, the controller in the bottomhole choke can measure pressure and control the valve of the bottomhole choke to provide real-time control the BHP. The BHP may be maintained around the desired pressure $P_T$ within an operational pressure window. Since the bottomhole choke may be positionable within a casing near the bottom of the wellbore, reverse-circulation cementing, rather than of conventional cementing, may be used to control the potential influx from the formation during cementing. At the conclusion of the cementing operation, the bottomhole choke may be retrieved.

In some embodiments according to the present disclosure, BHP during a cementing operation may be controlled using a choke at the surface of the well; the bottomhole choke may not be used. In such embodiments, pressure sensors and flow sensors may be instrumented in a sensing unit positionable at the bottom of the casing string or an inner tubing string to measure the BHP and the flow rate during the cementing operation. At the conclusion of the cementing operation, the sensing unit may be retrieved.

In some implementations, the transmission of the pressure and flow data from the sensing unit to the surface can be through various telemetry techniques (not shown), such as wired telemetry, mud pulse telemetry, electromagnetic (EM) telemetry, acoustic telemetry, or a combination of telemetry techniques according to the well conditions. In some implementations, the pressure and flow data may be stored locally on the sensing unit and recovered when the sensing unit is removed from the wellbore.

Illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

Conventional cementing processes pump fluids, such as cement, downhole within the casing and then uphole through the annulus, the annulus being the space between two casings, between a casing and tubing, or between casing and a wall of the wellbore, where fluid can flow. A reverse-circulation primary cementing process pumps the cement downhole in the annulus with the returns, for example wellbore fluids, taken uphole within the casing.

Figure 2:
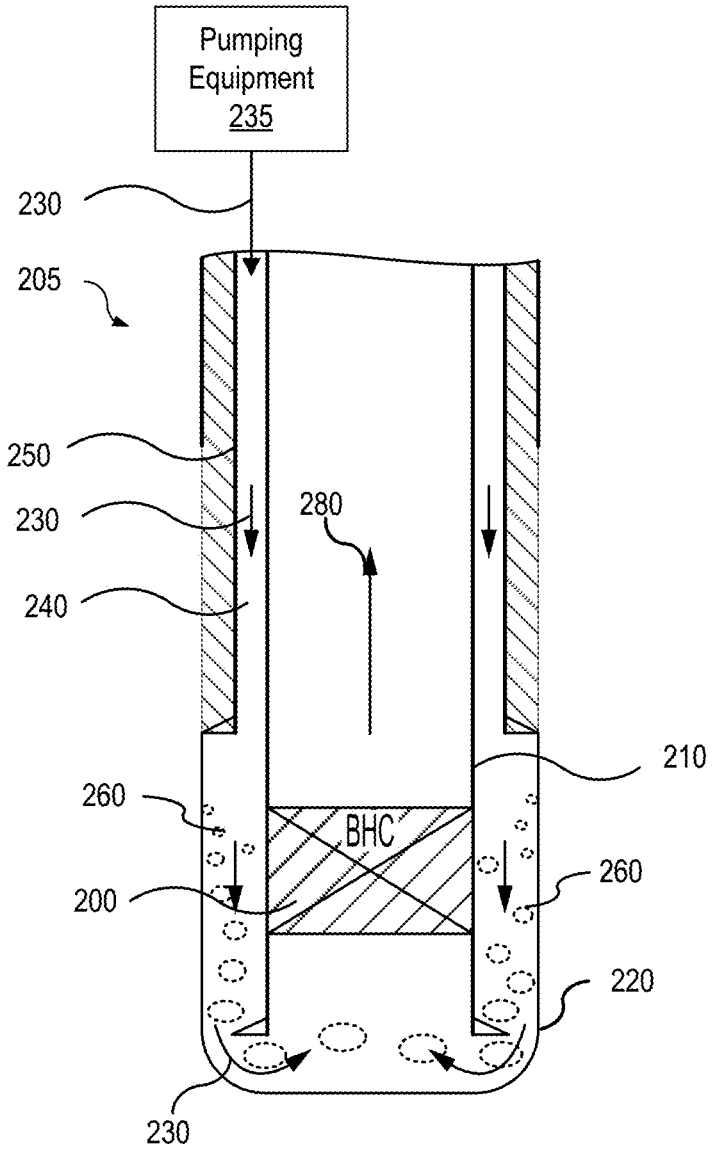
FIG. 2 is a cross-sectional view of a wellbore illustrating an example of a bottomhole choke positioned in a casing according to some aspects of the present disclosure.

FIG. 2 is a cross-sectional view of a wellbore illustrating an example of a bottomhole choke 200 positioned in a casing according to some aspects of the present disclosure. During managed pressure cementing (MPC), the bottomhole pressure (BHP) may be controlled to prevent damage to the wellbore and the formation as casings are cemented in place. The bottomhole choke 200 may be utilized to control the BHP during a reverse-circulation primary cementing process. Referring to FIG. 2, the bottomhole choke 200 may be positionable within a lower casing 210 in proximity to a bottomhole end of the wellbore 205 (e.g., the bottomhole 220). For example, the bottomhole choke 200 may be positionable above the bottom hole 220 without interfering the downhole cementing equipment.

During the reverse-circulation primary cementing process, cement pumping equipment 235 may pump cement 230 downhole in the annulus 240 formed between the previous casing 250, which has been cemented in place, and the lower casing 210 into the bottomhole 220 of the wellbore 205. The bottomhole choke 200 may be positionable in the lower casing 210.

Use of the bottomhole choke 200 may avoid influx from the formation. In cases where influx is present when the cement 230 is pumped downhole in the annulus 240, any wellbore fluids 260 from the formation that may be contained in the bottomhole 220 may be forced through the bottomhole choke 200. These fluids, also referred to as returns 280, may be forced uphole through the lower casing 210 and ultimately out of the wellbore 205. The bottomhole choke 200 may control the BHP by restricting the flow of the returns 280 to maintain a preset pressure or range of pressures.

Figure 3:
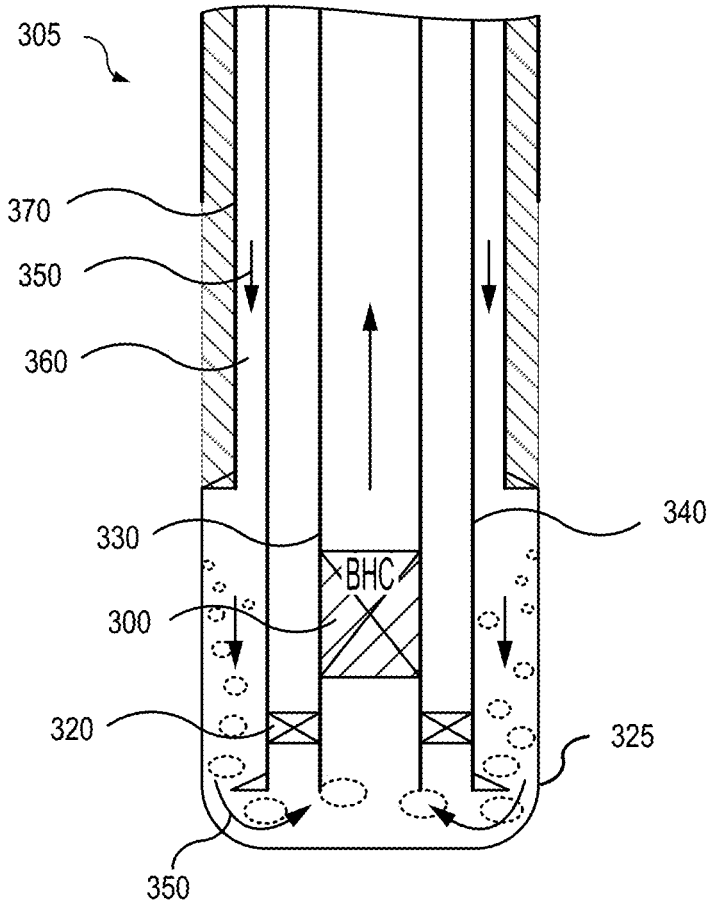
FIG. 3 is a cross-sectional view of a wellbore illustrating an example of a bottomhole choke positioned in an inner tubing string according to some aspects of the present disclosure.

FIG. 3 is a cross-sectional view of a wellbore illustrating an example of a bottomhole choke positioned in an inner tubing string according to some aspects of the present disclosure. Operation of the bottomhole choke 300 positioned in an inner tubing string 330 may be substantially similar to that of a bottomhole choke positioned in a casing as described above.

As illustrated in FIG. 3, during an MPC process, such as a reverse-circulation primary cementing process, a seal 320 may be placed between the inner tubing string 330 and a lower casing 340 to prevent flow of the cement or wellbore fluids from flowing uphole in the annulus between the inner tubing string 330 and the lower casing 340. Cement 350 may be pumped downhole in the annulus 360 between a previous casing 370 and the lower casing 340 into the bottomhole 325. Any wellbore fluids that may be contained in the bottomhole may be forced through the bottomhole choke 300. These fluids, also referred to as returns, may be forced uphole through the inner tubing string 330 and ultimately out of the wellbore 305. The bottomhole choke 300 may control the BHP by restricting the flow of returns to maintain a preset pressure.

Figure 4:
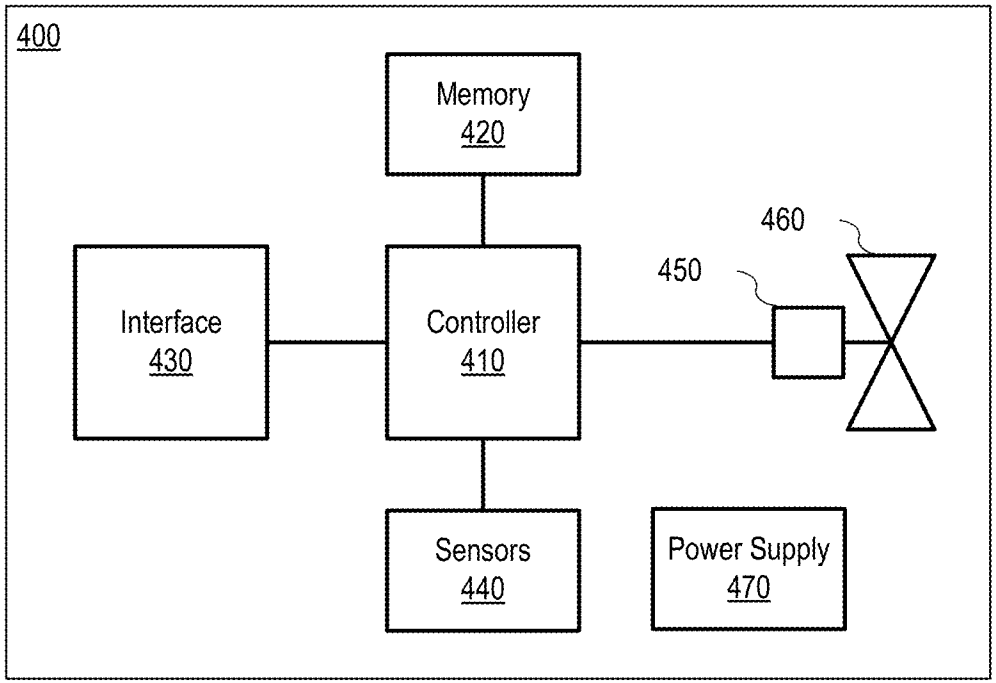
FIG. 4 is a block diagram of an example of a bottomhole choke according to some aspects of the present disclosure.

FIG. 4 is a block diagram of an example of a bottomhole choke 400 according to some aspects of the present disclosure. Referring to FIG. 4, the bottomhole choke 400 may include a controller 410, a memory 420, an interface 430, one or more sensors 440, a choke valve actuator 450, a controllable valve 460, and a power supply 470.

The controller 410 may be a microprocessor, a microcontroller, a Field-Programmable Gate Array ("FPGA"), an application-specific integrated circuit ("ASIC"), or other programmable device. The controller 410 may implement the control loop of FIG. 5. The control loop may be implemented in hardware (e.g., circuitry), as a software or firmware algorithm, or as a combination. Signals from the controller 410 may cause the choke valve actuator 450 to operate the controllable valve 460 to maintain the BHP at a specified pressure or within a range of specified pressures.

The memory 420 may be any suitable tangible and non-transitory computer-readable medium, such as RAM, ROM, EEPROM, or the like, can embody program components that configure operation of the controller 410.

The interface 430 may be a wired or wireless interface that communicates with an external input device. For example, the interface 430 may communicate with a wired or wireless keyboard or other external device such as a mobile device or computer.

The one or more sensors 440 may be pressure sensors or flow sensors or both. The sensors 440 may measure the BHP or fluid flow and provide signals to the controller 410.

The choke valve actuator 450 may be any type of actuator capable of being operated by the controller 410 to adjust the controllable valve 460. The controllable valve 460 may be any type of valve capable of being operated by the choke valve actuator to provide variable orifice sizes.

The power supply 470 may supply power for the bottomhole choke 400. The power supply 470 may be for example, a battery or other energy storage device. The power supply 470 may supply power to operate the components of the bottomhole choke 400, including, but not limited to, the controller 410 and the choke valve actuator 450.

Figure 5:
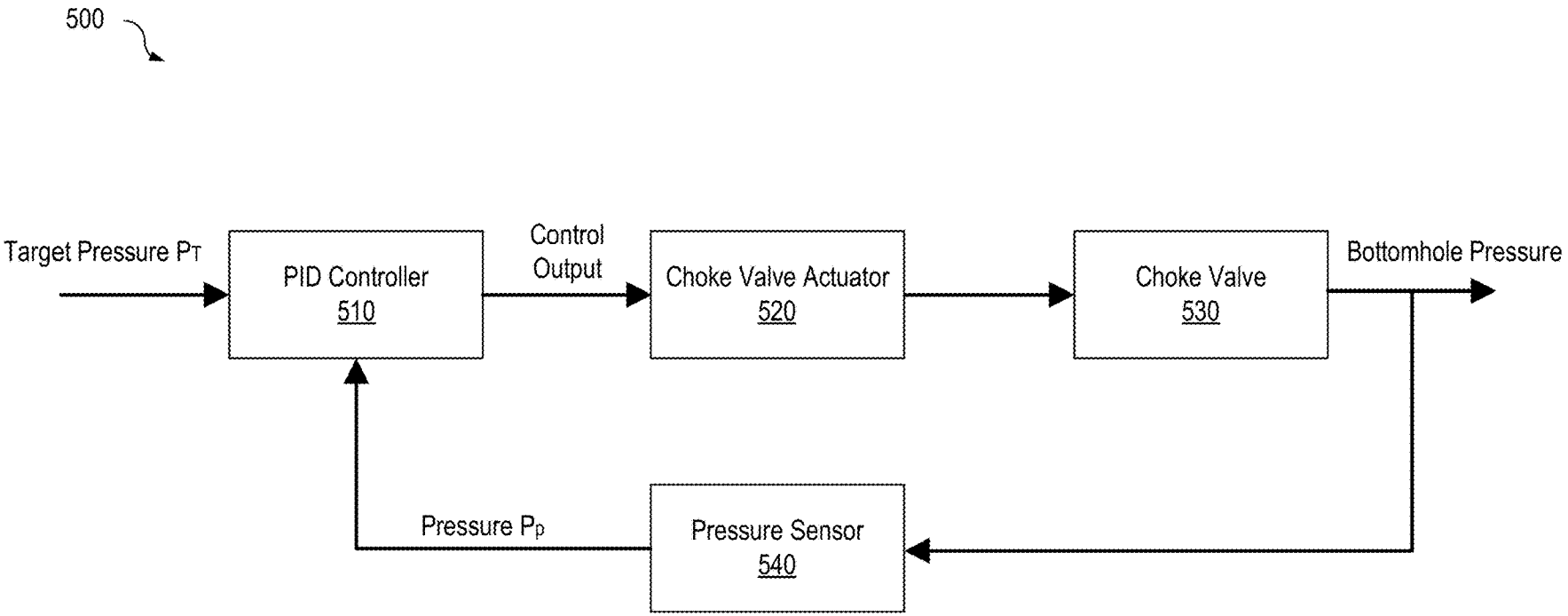
FIG. 5 is a block diagram of an example of a control loop that may be implemented by a controller for a bottomhole choke according to some aspects of the present disclosure.

FIG. 5 is a block diagram of an example of a control loop 500 that may be implemented by a controller for a bottomhole choke according to some aspects of the present disclosure. Referring to FIG. 5, a target pressure value $P_T$ may be input to a proportional-integral-differential (PID) controller 510 of the bottomhole choke prior to conveying the bottomhole choke downhole. For example, the target pressure value $P_T$ may be input via an input device such as a keyboard or other external device such as a mobile device or computer in communication with the interface of the bottomhole choke. The target pressure value $P_T$ may be specified within an operational pressure window, such as upper and lower pressure limits, between the pressure of fluids within the pores of a reservoir (pore pressure) and the pressure required to induce fractures in rock at a given depth (facture gradient). The target pressure value $P_T$ may be determined based on the characteristics of the wellbore, for example, depth of the wellbore, composition of the formation, etc. In some implementations, the PID controller may be implemented by the controller of the bottomhole choke (e.g., the controller 410). In some implementations, the PID controller may be implemented by a controller separate from the controller of the bottomhole choke.

During the MPC process, such as a reverse-circulation primary cementing process, the pressure sensors 540 may a sense the bottomhole pressure generated by the cement being pumped into the bottomhole. The pressure sensors 540 may generate a bottom hole pressure signal PP that is communicated to the PID controller 510. The PID controller 510 may operate on the target pressure value $P_T$ and the bottomhole pressure signal PP to generate a control signal to the choke valve actuator 520.

In response to the control signal, the choke valve actuator 520 may operate the controllable valve 530 to control the BHP. For example, the choke valve actuator 520 may cause the controllable valve 530 to increase the size of the orifice or decrease the size of the orifice to decrease or increase the BHP, respectively. In some implementations, the controller (e.g., the controller 410) or the bottomhole choke may store the controllable valve position, for example, the size of the orifice, and the corresponding BHP for use in subsequent analysis of the MPC process. Since BHP is sensed and controlled autonomously in real-time by the bottomhole choke in the bottomhole, more accurate pressure control may be achieved than with surface chokes.

Figure 6:
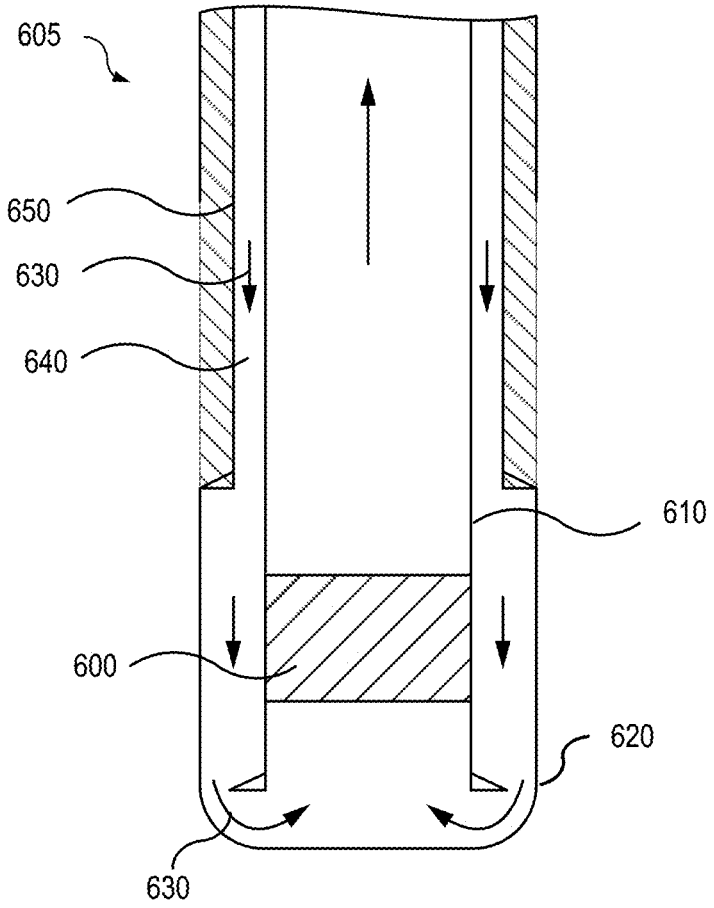
FIG. 6 is a cross-sectional view of a wellbore illustrating an example of a sensing unit positioned in a casing according to some aspects of the present disclosure.

In some embodiments, a sensing unit similar to the sensor portion of the bottomhole choke may be provided. The sensing unit may sensing unit provide bottomhole pressure and flow measurements which may be utilized, for example, for controlling a surface choke during cementing processes or for other bottomhole operations. FIG. 6 is a cross-sectional view of a wellbore illustrating an example of a sensing unit 600 positioned in a casing according to some aspects of the present disclosure. The sensing unit 600 may be utilized during bottomhole operations, for example, but not limited to, reverse-circulation primary cementing processes. As illustrated in FIG. 6, the sensing unit 600 may be positionable in a lower casing 610 positioned in the bottomhole 620.

As an example, during a cementing process, such as a reverse-circulation primary cementing process, cement 630 may be pumped downhole in an annulus 640 formed between a previous casing 650, which has been cemented in place, and a lower casing 610 into the bottomhole 620 of the wellbore 605. The sensing unit 600 may be positionable in the lower casing 610. As the cement 630 is pumped downhole in the annulus 640, fluid flow and pressure in the bottomhole 620 may be sensed by the sensing unit 600. Pressure and flow data may be transmitted to the surface and utilized to control a surface choke to regulate the reverse-circulation primary cementing process.

Transmission of the pressure and flow data from the sensing unit to the surface can be through various telemetry techniques (not shown), such as wired telemetry, mud pulse telemetry, electromagnetic (EM) telemetry, acoustic telemetry, or a combination of telemetry techniques according to the well conditions.

Figure 7:
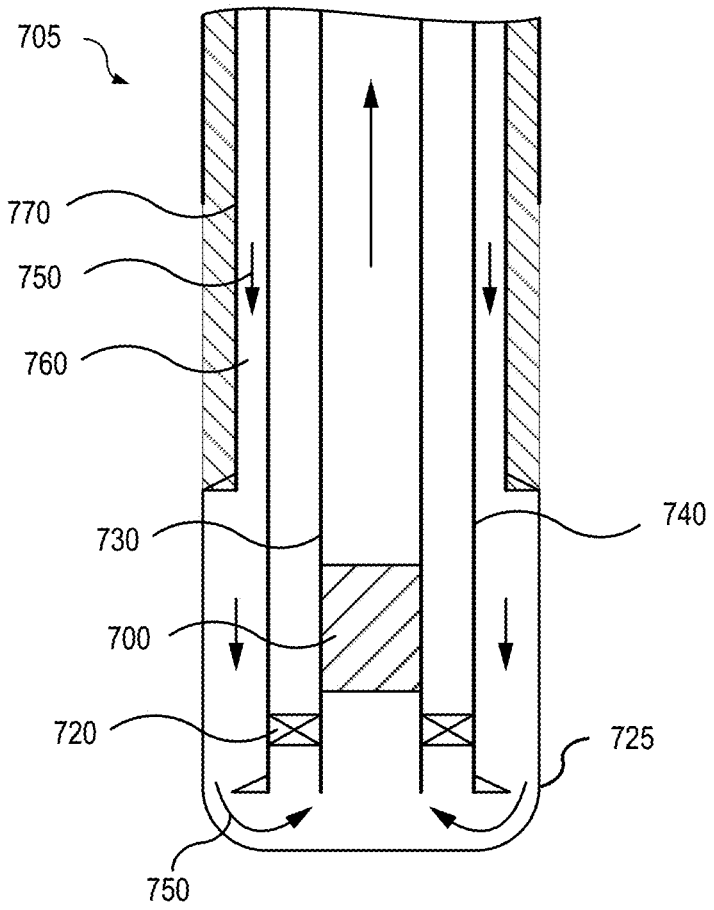
FIG. 7 is a cross-sectional view of a wellbore illustrating an example of a sensing unit positioned in an inner tubing string according to some aspects of the present disclosure.

FIG. 7 is a cross-sectional view of a wellbore illustrating an example of a sensing unit positioned in an inner tubing string according to some aspects of the present disclosure. Operation of the sensing unit 700 positionable in an inner tubing string 730 may be substantially similar to that of a sensing unit positioned in a casing as described above.

As illustrated in FIG. 7, during an MPC process, such as a reverse-circulation primary cementing process, a seal 720 may be placed between the inner tubing string 730 and a lower casing 740 to prevent flow of fluids uphole in the annulus between the inner tubing string 730 and the lower casing 740. Cement 750 may be pumped downhole in the annulus 760 between a previous casing 770, and the lower casing 740 which has been cemented in place, into the bottomhole 725 of the wellbore 705. As the cement 750 is pumped downhole in the annulus 760, fluid flow and pressure in the bottomhole 725 may be sensed by the sensing unit 700. Pressure and flow data may be transmitted to the surface and utilized to control a surface choke to regulate the reverse-circulation primary cementing process.

In some implementations, the transmission of the pressure and flow data from the sensing unit to the surface can be through various telemetry techniques (not shown), such as wired telemetry, mud pulse telemetry, electromagnetic (EM) telemetry, acoustic telemetry, or a combination of telemetry techniques according to the well conditions. In some implementations, the pressure and flow data may be stored locally on the sensing unit and recovered when the sensing unit is removed from the wellbore. Data recovered from the sensing unit may be utilized for post-analysis of downhole operations.

Figure 8:
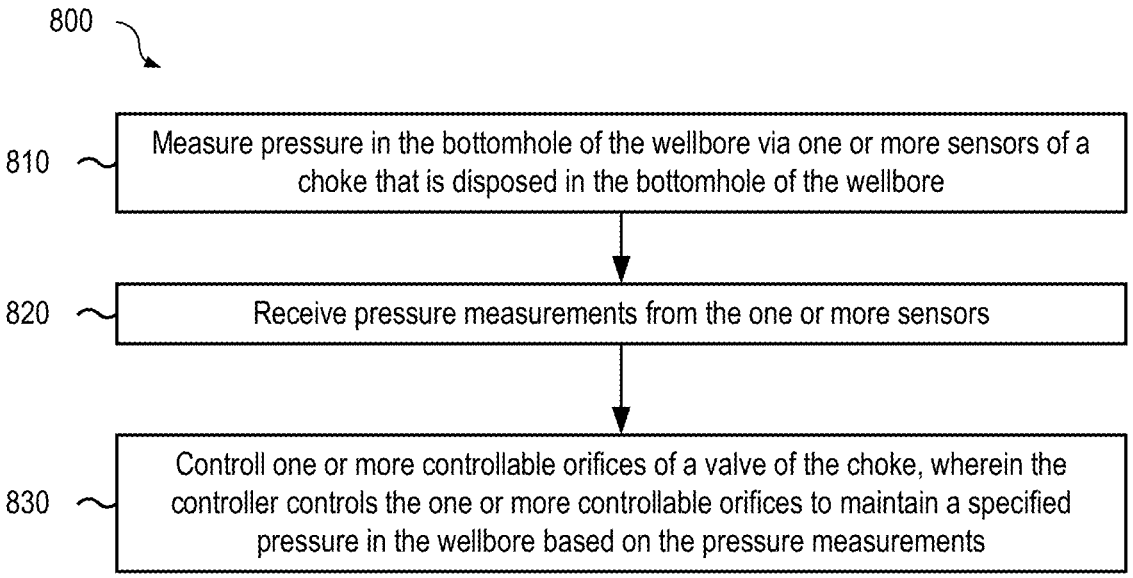
FIG. 8 is a flow chart of an example of a method for controlling bottomhole pressure in a wellbore according to some aspects of the present disclosure

FIG. 8 is a flow chart of an example of a method 800 for controlling bottomhole pressure in a wellbore according to some aspects of the present disclosure. In some implementations, one or more process blocks of FIG. 8 may be performed by a controller of the choke that is positionable in the bottomhole of the wellbore. In some implementations, one or more process blocks of FIG. 8 may be performed by another device or a group of devices including the controller of the choke that is positionable in the bottomhole of the wellbore.

As illustrated in FIG. 8, at block 810, the method 800 may include measuring pressure in the bottomhole of the wellbore via one or more sensors of a choke that is positionable in the bottomhole of the wellbore. For example, the controller of the choke that is positionable in the bottomhole of the wellbore may measure pressure in the bottomhole of the wellbore via one or more sensors of the choke that is positionable in the bottomhole of the wellbore, as described above.

As further illustrated in FIG. 8, at block 820, the method 800 may include receiving pressure measurements from the one or more sensors. For example, the controller of the choke that is positionable in the bottomhole of the wellbore may receive pressure measurements from the one or more sensors, as described above.

As further shown in FIG. 8, at block 830, the method 800 may include controlling a controllable valve of the choke. In an example, the controller controls the controllable valve to maintain a specified pressure in the wellbore based on the pressure measurements. For example, the controller of the choke that is positionable in the bottomhole of the wellbore may control the controllable valve of the choke, as described above. In some implementations, the controller controls the controllable valve to maintain a specified pressure in the wellbore based on the pressure measurements.

The method 800 may include additional implementations, such as any single implementation or any combination of implementations described below and/or in connection with one or more other processes described elsewhere herein.

In some implementations, the method 800 may include installing the choke within a downhole end of a wellbore casing and conveying the choke and wellbore casing downhole. In some implementations, the specified pressure may be programmed into a memory of the choke prior to conveying the choke downhole. In some implementations, the specified pressure may be determined based on depth of the wellbore and characteristics of a formation at the depth of the wellbore.

In some implementations, the controller may be a proportional-integral-derivative (PID) controller. In some implementations, the controllable valve may be a choke valve having a variable orifice, and the choke valve may be operated by an actuator that receives control signals from the controller. In some implementations, the choke may control downhole pressure for a reverse-circulation primary cementing process.

The specific operations illustrated in FIG. 8 provide a particular method for controlling bottomhole pressure in a wellbore according to an embodiment of the present disclosure. Other sequences of operations may also be performed according to alternative embodiments. For example, alternative embodiments of the present disclosure may perform the operations outlined above in a different order. Moreover, the individual operations illustrated in FIG. 8 may include multiple sub-operations that may be performed in various sequences as appropriate to the individual operation. Furthermore, additional operations may be added or removed depending on the particular applications.

The method 800 may be embodied on a non-transitory computer readable medium, for example, but not limited to, the memory 420 or other non-transitory computer readable medium known to those of skill in the art, having stored therein a program including computer executable instructions for making a processor, computer, or other programmable device execute the operations of the method According to some aspects of the present disclosure, an autonomous bottomhole choke is provided. The bottomhole choke can provide real-time pressure sensing and pressure control by controlling the choke valve actuator at the bottom of the wellbore, thereby providing faster compensation for variations of BHP. The autonomous operation of the bottomhole choke, when used for MPC or other bottomhole operations, can minimize surface equipment and telemetry system for BHP measurement and control, and may eliminate reliance on a hydraulic model to predict and control BHP.

According to some aspects of the present disclosure, a sensing unit is provided that may provide bottomhole pressure and flow measurements which may be utilized, for example, for controlling a surface choke during cementing processes or for other bottomhole operations. As used below, any reference to a series of examples is to be understood as a reference to each of those examples disjunctively (e.g., "Examples 1-4" is to be understood as "Examples 1, 2, 3, or 4").

Example 1 is an apparatus for controlling bottomhole pressure in a wellbore during cementing, the apparatus including a sensor positionable to measure the bottomhole pressure of the wellbore, a controllable valve, and a controller positionable to receive pressure measurements from the sensor, and control the controllable valve to maintain a specified pressure in the wellbore based on the pressure measurements, wherein the apparatus is positionable in a bottomhole portion of the wellbore.

Example 2 is the apparatus of example 1, wherein the apparatus is positionable within a downhole end of a wellbore casing prior to conveying the wellbore casing downhole within the wellbore.

Example 3 is the apparatus of example(s) 1 or 2, further comprising: a memory, wherein the specified pressure is programmable into the memory prior to conveying the wellbore casing downhole.

Example 4 is the apparatus of example(s) 1-3, wherein the specified pressure comprises a pressure range between a pore pressure and a fracturing gradient of a formation.

Example 5 is the apparatus of example(s) 1-4, wherein the memory is operable to store downhole pressure measurements and valve positions during downhole operations.

Example 6 is the apparatus of example(s) 1-5, wherein the controller comprises a proportional-integral-derivative (PID) controller.

Example 7 is the apparatus of example(s) 1-6, wherein the apparatus is positionable to control the bottomhole pressure for a cementing operation.

Example 8 is the apparatus of example(s) 1-7, wherein: the controllable valve comprise a choke valve; and the choke valve is controllable by an actuator that receives control signals from the controller positionable at the bottomhole portion of the wellbore.

Example 9 is a system for performing a cementing process in a wellbore, the system including pumping equipment positionable to pump cement into a bottom hole portion of a wellbore, and a choke positionable in a bottomhole portion of the wellbore to control bottomhole pressure in the wellbore during the cementing process, wherein the choke includes a sensor positionable to measure the bottomhole pressure of the wellbore, a controllable valve, and a controller positionable to receive pressure measurements from the sensor during the cementing process, and control the controllable valve to maintain a specified pressure in the wellbore based on the pressure measurements.

Example 10 is the system of example 9, wherein the choke is positionable within a downhole end of a wellbore casing prior to conveying the wellbore casing downhole within the wellbore.

Example 11 is the system of example(s) 9 or 10, further including a memory, wherein the specified pressure is programmable into the memory prior to conveying the wellbore casing downhole.

Example 12 is the system of example(s) 9-11, wherein the specified pressure includes a pressure range between a pore pressure and a fracturing gradient of a formation.

Example 13 is the system of example(s) 9-12, wherein the memory is operable to store downhole pressure measurements and valve positions during downhole operations.

Example 14 is the system of example(s) 9-13, wherein the cementing process is a reverse-circulation primary cementing process.

Example 15 is a method for controlling bottomhole pressure in a wellbore, the method including measuring the bottomhole pressure of the wellbore via a sensor that is positionable in a bottomhole of the wellbore, receiving, by a controller that is positionable in the bottomhole of the wellbore, pressure measurements from the sensor, and controlling, by the controller, a controllable valve of a valve of that is positionable in the bottomhole of the wellbore to maintain a specified pressure in the wellbore based on the pressure measurements.

Example 16 is the method of example 15, further including installing a choke comprising the sensor, the controller, and the controllable valve within a downhole end of a wellbore casing prior to conveying the wellbore casing downhole within the wellbore.

Example 17 is the method of example(s) 15 or 16, wherein the specified pressure is programmable into a memory of the choke prior to conveying the wellbore casing downhole.

Example 18 is the method of example(s) 15-17, wherein the specified pressure includes a pressure range between a pore pressure and a fracturing gradient of a formation.

Example 19 is the method of example(s) 15-18, wherein: the controllable valve is a choke valve; and the choke valve is operated using an actuator controlled by the controller positionable at the bottomhole portion of the wellbore.

Example 20 is the method of example(s) 15-19, wherein controlling the controllable valve includes controlling the bottomhole pressure for a reverse-circulation primary cementing process.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. An apparatus for controlling bottomhole pressure in a wellbore during cementing, the apparatus comprising:
- a sensor positionable to measure the bottomhole pressure of the wellbore;
- a controllable valve; and
- a controller positionable to:
  - receive pressure measurements from the sensor;
  - determine a specified pressure based on physical characteristics of the wellbore; and
  - control the controllable valve to maintain the specified pressure in the wellbore based on the pressure measurements,
- wherein the apparatus is positionable in a bottomhole portion of the wellbore, and
- wherein the controller is positionable to control a flow of return fluids uphole through the controllable valve to maintain the specified pressure in the wellbore.

2. The apparatus of claim 1, wherein the apparatus is positionable within a downhole end of a wellbore casing prior to conveying the wellbore casing downhole within the wellbore.

3. The apparatus of claim 2, further comprising:
- a memory,
- wherein the specified pressure is programmable into the memory prior to conveying the wellbore casing downhole.

4. The apparatus of claim 3, wherein the specified pressure comprises a pressure range between a pore pressure and a fracturing gradient of a formation.

5. The apparatus of claim 3, wherein the memory is operable to store downhole pressure measurements and valve positions during downhole operations.

6. The apparatus of claim 1, wherein the controller comprises a proportional-integral-derivative (PID) controller.

7. The apparatus of claim 1, wherein the apparatus is positionable to control the bottomhole pressure for a cementing operation.

8. The apparatus of claim 1, wherein:
- the controllable valve comprises a choke valve; and
- the choke valve is controllable by an actuator that receives control signals from the controller positionable at the bottomhole portion of the wellbore.

9. A system for performing a cementing process in a wellbore, the system comprising:
- pumping equipment positionable to pump cement into a bottomhole portion of a wellbore; and
- a choke positionable in a bottomhole portion of the wellbore to control bottomhole pressure in the wellbore during the cementing process, wherein the choke comprises:
  - a sensor positionable to measure the bottomhole pressure of the wellbore;
  - a controllable valve; and
  - a controller positionable to:
    - receive pressure measurements from the sensor during the cementing process;
    - determine a specified pressure based on physical characteristics of the wellbore; and
    - control the controllable valve to maintain the specified pressure in the wellbore based on the pressure measurements,
    - wherein the controller is positionable to control a flow of return fluids uphole through the controllable valve to maintain the specified pressure in the wellbore.

10. The system of claim 9, wherein the choke is positionable within a downhole end of a wellbore casing prior to conveying the wellbore casing downhole within the wellbore.

11. The system of claim 10, further comprising:
- a memory,
- wherein the specified pressure is programmable into the memory prior to conveying the wellbore casing downhole.

12. The system of claim 11, wherein the specified pressure comprises a pressure range between a pore pressure and a fracturing gradient of a formation.

13. The system of claim 11, wherein the memory is operable to store downhole pressure measurements and valve positions during downhole operations.

14. The system of claim 9, wherein the cementing process comprises a reverse-circulation primary cementing process.

15. A method for controlling bottomhole pressure in a wellbore, the method comprising:
- measuring the bottomhole pressure of the wellbore via a sensor that is positionable in a bottomhole of the wellbore;

receiving, by a controller that is positionable in the bottomhole of the wellbore, pressure measurements from the sensor;

determining, by the controller, a specified pressure based on physical characteristics of the wellbore; and controlling, by the controller, a controllable valve of a valve that is positionable in the bottomhole of the wellbore to maintain the specified pressure in the wellbore based on the pressure measurements, wherein the controller is positionable to control a flow of return fluids uphole through the controllable valve to maintain the specified pressure in the wellbore.

16. The method of claim 15, further comprising installing a choke comprising the sensor, the controller, and the controllable valve within a downhole end of a wellbore casing prior to conveying the wellbore casing downhole within the wellbore.

17. The method of claim 16, wherein the specified pressure is programmable into a memory of the choke prior to conveying the wellbore casing downhole.

18. The method of claim 17, wherein the specified pressure comprises a pressure range between a pore pressure and a fracturing gradient of a formation.

19. The method of claim 15, wherein:

the controllable valve comprises a choke valve; and the choke valve is operated using an actuator controlled by the controller positionable at a bottomhole portion of the wellbore.

20. The method of claim 15, wherein controlling the controllable valve comprises controlling the bottomhole pressure for a reverse-circulation primary cementing process.

* * * * *